United States Patent [19]

Tepper

[11] Patent Number: 4,620,323

[45] Date of Patent: Nov. 4, 1986

[54] DISPOSABLE BABY BIB

[76] Inventor: Marla Tepper, 1304 Linden, Highland Park, Ill. 60035

[21] Appl. No.: 788,766

[22] Filed: Oct. 18, 1985

[51] Int. Cl.[4] ..... A41B 13/10

[52] U.S. Cl. ..... 2/49 R

[58] Field of Search ..... 2/48–49, 2/50–52

[56] References Cited

U.S. PATENT DOCUMENTS 3,286,279 11/1966 Brown ..... 2/49 R

*Primary Examiner*—Doris L. Troutman

*Attorney, Agent, or Firm*—Silverman, Cass, Singer & Winburn, Ltd.

[57] ABSTRACT

A disposable bib having a body portion which is contoured for a closer fit and added protection against drips and consequent stains and has a perforated inner border along the bottom and at least part of the sides for retaining drips and spills. The bib also has a gathered portion at the neck for a close fit and to present a larger surface area to block drips and spills and is secured around the neck of the wearer by, for example, resealable tape.

14 Claims, 3 Drawing Figures

DISPOSABLE BABY BIB

BACKGROUND OF THE INVENTION

1. Technical Field

This invention relates to a bib and more particularly to a disposable bib which is useful in the same manner as the standard cloth bibs used on babys, patients and the like to protect clothing and undergarments especially while eating.

2. Background Art

Various constructions for bibs, disposable or otherwise, are known in the prior art. For example, U.S. Pat. No. 2,523,565 to Gardner, discloses a disposable bib with a tuck-in member to tuck in under a child's clothing. U.S. Pat. No. 2,571,888 to Jesse, discloses a bib having a thickened or padded neck-notch which is covered with a powder to reduce chaffing and irritation. In U.S. Pat. No. 2,688,750 to Mink, a bib is disclosed having a neck opening which is adjustable by a drawstring.

U.S. Pat. No. 2,760,200 to Shamyer discloses a disposable bib with interlocking straps for maintaining the bib around a child's neck and which lends itself to stacking in superimposed quantities for packaging storage and shipment. U.S. Pat. No. 3,286,279 to Brown discloses a disposable bib having a front surface which is of a ribbed material defining diamond-shaped apertures to expose the interior of the bib and catch and direct spilled food. The bib further includes as absorbent material disposable napkins held in stack alignment inside the bib. U.S. Pat. No. 3,328,807 to Strauss discloses a disposable bib wherein the bottom of the bib may be turned up and fastened to provide a receptacle protecting the lap of the diner. U.S. Pat. No. 3,416,157 to Marder et al. discloses a disposable bib with improved means for adjusting and securing the bib around the neck of the wearer. U.S. Pat. No. 3,979,776 to Gruenwald discloses a disposable bib which is secured to the shoulders of the wearer.

More recently, U.S. Pat. No. 4,475,250 to Savin et al. discloses a disposable bib having a neck opening and a pair of tear away tie strips for securing about the neck of the wearer. U.S. Pat. Nos. 4,495,658; 4,523,333 and 4,523,334 are directed to disposable bibs with improved fastening means.

SUMMARY OF THE INVENTION

The present invention provides a disposable bib having a body with an opening at one end which fits around the neck of the wearer and has means for resealably securing the ends of the opening around the neck of the wearer. At least the bottom portion of the opening is gathered to achieve a closer fit to the neck of the wearer and to present a substantially larger surface area of absorbent material to better protect clothing worn underneath the bib from drips and spills.

The bib of the present invention also includes a perforated inner border along the sides and bottom of the body of the bib for retaining drips and spills at least as efficiently as prior art constructions but in a manner which greatly facilitates manufacture of commercial quantities in that less material is used than in prior art designs which have some additional means at the bottom of the bib for catching drips. Also, the perforations of the present invention requires fewer manufacturing steps than comparable prior art designs and therefore further decreases manufacturing costs.

Finally, the body of the bib is contoured to more closely fit the body of the wearer while avoiding folds and gaps which reduce the efficiency of the bib. The combination of these features provides a disposable bib which fits better and closer to the wearer than prior art disposable bibs, far more effectively protects the clothing from drips and spills and can be manufactured in commercial quantities easier and less expensively than prior art designs.

DESCRIPTION OF THE PREFERRED EMBODIMENTS

Figure 1:
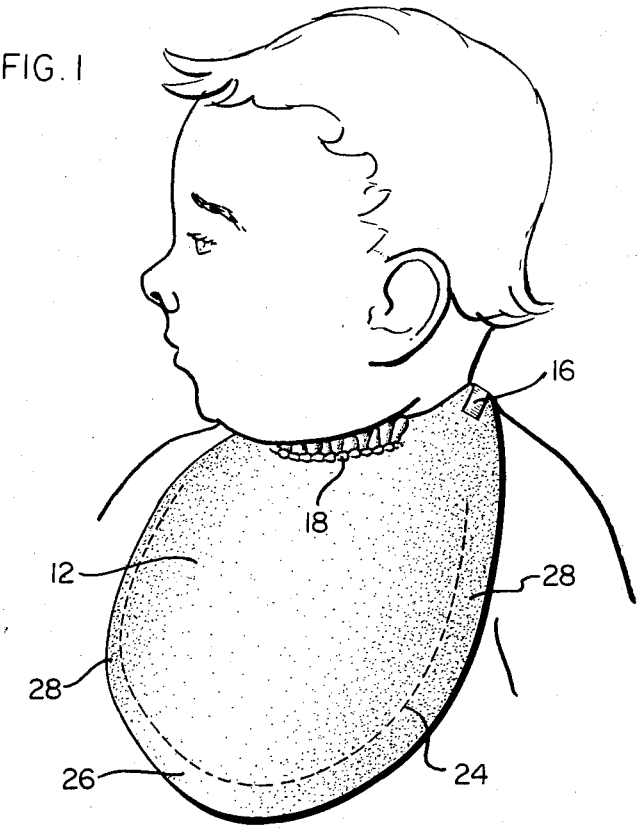
FIG. 1 illustrates a perspective view of an embodiment of a disposable bib in accordance with the present invention in use on a baby.
Figure 2:
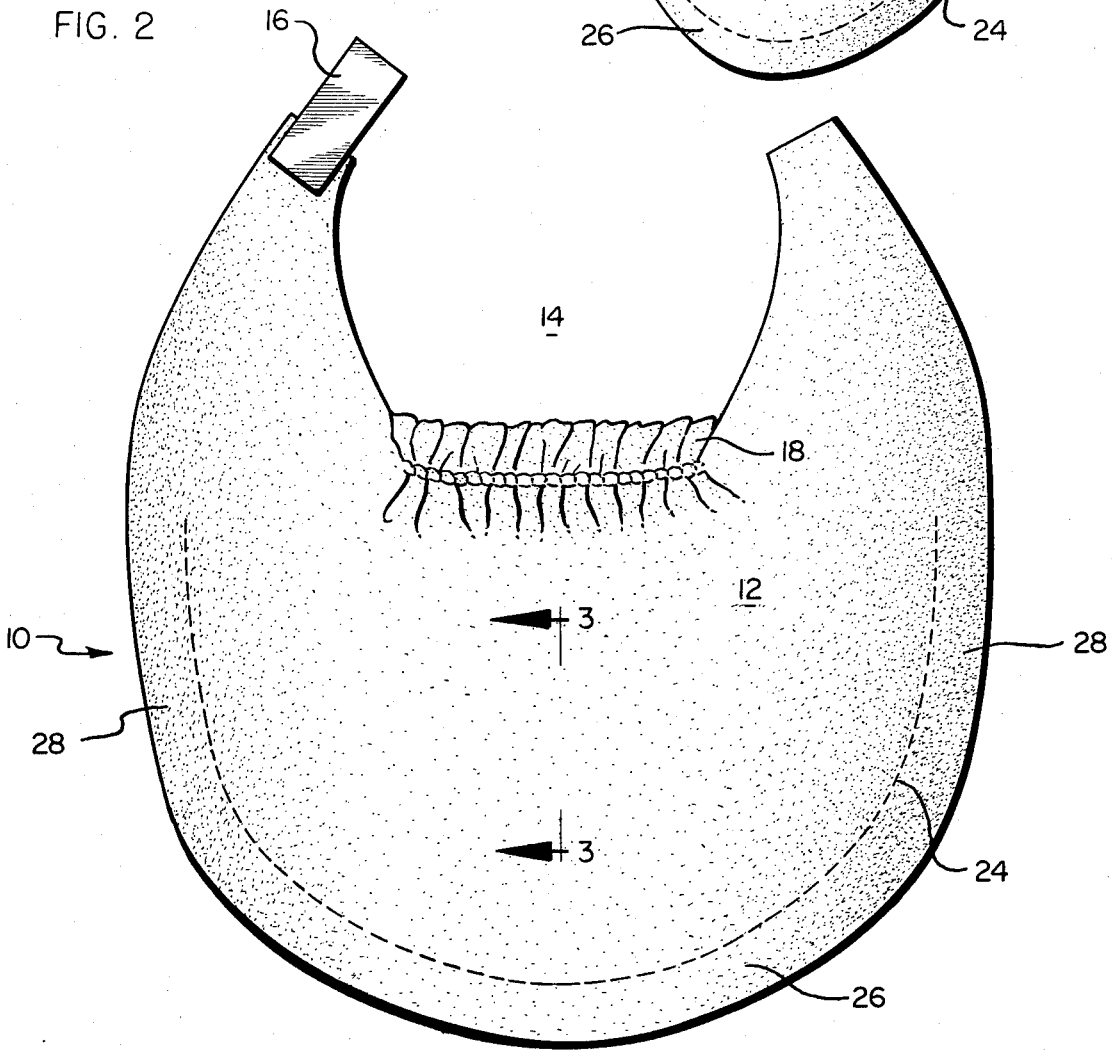
FIG. 2 illustrates a front view of a disposable bib in accordance with the present invention.

Referring now more particularly to the figures, wherein like reference numerals are employed for like features, there is shown in FIGS. 1 and 2 an embodiment of a disposable bib 10 in accordance with the invention. The bib 10 includes a body 12 with an opening 14 at one end which at least partially encircles the neck of the wearer. The opening 14 is secured around the neck of the wearer by appropriate means 16 such as resealable tape or the like.

The body 12 is preferably fashioned with a fitted or contoured shape which more closely follows the body contours of the wearer. This is a feature which is unknown to the prior art in a disposable bib and represents a very significant improvement thereover. While prior art flat disposable bibs will certainly bend or fold to roughly follow the body contours of the wearer, in the course of such bending or folding gaps will inevitably occur in the material making the bib less efficient by allowing spills to get past such as at the neck region, and more likely to tear, puncture, or otherwise break down. For example, in the prior art, because of the uneven contours, spills may become concentrated in a particular area, causing excess saturation and premature tears or loss of absorbing characteristics due to oversaturation.

The neck opening 14 also includes, in a preferred embodiment, a gathered portion 18 along at least the bottom of the opening 14. Gathered portion 18 can be achieved by any number of conventional methods such as stitching alone, or sewing in an elastic portion, etc. This portion 18 serves both to achieve a closer fit between the neck opening 14 and the neck of the wearer than was achieved in the prior art and to concentrate more absorbent material with a larger surface area at the neck of the wearer to better prevent drips and spills from running past and staining the wearer's clothes. By achieving both a closer fit and a larger surface area of absorbent materials, this feature of the bib of the present invention represents a significant improvement over prior art bibs.

Figure 3:
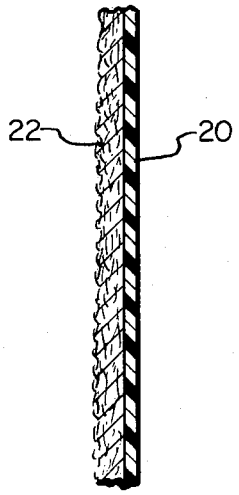
FIG. 3 illustrates a partial cross-sectional view taken at line 3—3 of FIG. 2.

The body 12 of the bib 10, as best shown in FIG. 3, preferably comprises at least a first layer 20 and a second layer 22. The first layer 20 preferably is formed of a material which is substantially impermeable to liquids and other types of spills normally encountered while eating. The outside layer 22 may preferably be fashioned from absorbent paper materials such as those employed in disposable diapers.

The bib 10 may also include a third layer (not shown) on the side of the absorbent material 22 opposite the first layer 20. This third layer would preferably be a permeable and absorbent material such as absorbent paper to absorb and direct spills to the second absorbent layer 22.

As shown in FIGS. 1 and 2, the body 12 of the bib 10 also preferably includes a perforated inner border 24 along the bottom 26 and at least part of the sides 28 of the body 12. The perforated border 24 serves as a further barrier to retain drips and spills not absorbed by second layer 22, or a third layer if present, before such spills can run off the bib 10 and stain the clothing. This feature also represents a significant improvement not found in the prior art. Besides the spill retaining capability, the feature affords such additional capability in a manner that is extremely easy and inexpensive to include in the manufacture of a disposable bib. Prior art bibs have included various sorts of pockets, etc., at the lower end of the bib to achieve a similar purpose. However, these are all substantially more difficult and expensive to manufacture, requiring as they do additional material, and at least one extra manufacturing step to attach the sides of the pocket to the body of the bib.

The preferred embodiment of a contoured absorbent disposable bib having a gathered neck and perforated inner border to catch drips and spills represents a significant advance over the prior art. While the aforementioned patents disclose bib constructions which deal with some of the needs for such products, they have not solved these needs in the manner or degree of the present invention. Neither is a disposable bib disclosed in the prior art which can be manufactured as efficiently and cheaply while achieving the efficiency of the present invention.

Variations and modifications of the present invention are possible without departing from the spirit and scope of the present invention.

What is claimed is:

1. A disposable bib comprising:

a body having an opening at one end to encircle at least part of the neck of the wearer;

a perforated inner border substantially along the sides and end of said body opposite said opening and extending approximately to the bottom of said opening to retain drips and spills; and means for securing said opening around the neck of the wearer.

2. A disposable bib according to claim 1 wherein said body is contoured to more closely fit to the wearer's body.

3. A disposable bib according to claim 1 wherein at least the bottom portion of said opening being gathered to achieve a closer fit and present a substantially larger surface area to the neck of the wearer.

4. A disposable bib according to claim 1 wherein said body includes at least a first and a second layer, said first layer being substantially impermeable to liquids, said second layer including an absorbent material for absorbing drips and spills.

5. A disposable bib according to claim 1 wherein said means for securing said opening comprise resealable means.

6. A disposable bib having a body with an opening at one end to encircle the neck of the wearer and means for securing said opening adjacent the neck of the wearer, the improvement comprising in combination:

a perforated inner border substantially along the sides and end of said body opposite said opening and extending approximately to the bottom of said opening to retain drips and spills; and at least the bottom portion of said opening being gathered to achieve a closer fit and present a substantially larger surface area to the neck of the wearer.

7. A disposable bib according to claim 6 wherein said body is contoured to more closely fit to the wearer's body.

8. A disposable bib according to claim 6 wherein said body includes at least a first and a second layer, said first layer being substantially impermeable to liquids, said second layer including an absorbent material for absorbing drips and spills.

9. A disposable bib according to claim 6 wherein said means for securing said opening comprise resealable means.

10. A method of manufacturing a disposable bib comprising:

forming a body having an opening at one end to encircle at least part of the neck of the wearer;

providing a perforated inner border substantially along the sides and end of said body opposite said opening and extending approximately to the bottom end of said opening to retain drips and spills; and providing means for securing said opening around the neck of the wearer.

11. A method of manufacturing a disposable bib according to claim 10 wherein said step of forming said body includes forming said body with a contour to more closely fit to the wearer's body.

12. A method of manufacturing a disposable bib according to claim 10 including gathering at least the bottom portion of said opening being to achieve a closer fit and provide a substantially larger surface area to the neck of the wearer.

13. A method of manufacturing disposable bib according to claim 10 wherein said step of forming said body includes forming said body with at least a first and a second layer, said first layer being substantially impermeable to liquids, said second layer including an absorbent material for absorbing drips and spills.

14. A method of manufacturing a disposable bib according to claim 10 wherein said step of providing said means for securing said opening includes providing resealable means.

* * * * *